United States Patent [19]

McLoughlin

[11] 4,348,012

[45] Sep. 7, 1982

[54] INTRUDER BARRIER

[75] Inventor: Thomas P. McLoughlin, Dublin, Ireland

[73] Assignee: MNJ Engineering Company Limited, Dublin, Ireland

[21] Appl. No.: 6,158

[22] Filed: Jan. 24, 1979

[30] Foreign Application Priority Data

| | | | |
|---|---|---|---|
| Jan. 25, 1978 | [IE] | Ireland | 162/78 |
| Jul. 11, 1978 | [IE] | Ireland | 1388/78 |
| Nov. 22, 1978 | [IE] | Ireland | 2296/78 |

[51] Int. Cl.[3] ..... E04H 17/00

[52] U.S. Cl. ..... 256/12; 256/16

[58] Field of Search ..... 256/11, 12, 16, 1

[56] References Cited

U.S. PATENT DOCUMENTS

| | | | |
|---|---|---|---|
| 259,654 | 6/1882 | Worthington | 256/12 |
| 321,171 | 0/1885 | Archibald . | |
| 399,617 | 3/1889 | Ihnen | 256/12 |
| 435,708 | 0/1890 | Poole . | |
| 504,936 | 0/1893 | Niles . | |
| 511,700 | 12/1893 | Jacobs | 256/12 |
| 511,701 | 12/1893 | Jacobs | 256/12 |
| 585,548 | 6/1897 | Allen | 256/16 |
| 772,364 | 10/1904 | Mallia | 256/16 |

FOREIGN PATENT DOCUMENTS

| | | | |
|---|---|---|---|
| 28488 | 1/1918 | Norway | 256/12 |
| 612265 | 11/1948 | United Kingdom | 256/12 |

*Primary Examiner*—Andrew V. Kundrat

*Attorney, Agent, or Firm*—Ladas & Parry

[57] ABSTRACT

An intruder barrier for mounting on the top or side face of a wall is provided. The intruder barrier consists essentially of a scaling barrier formed from a number of blades radially arranged and rotatable about a longitudinal axis so that any attempt to climb the wall is foiled as the blades simply rotate thus not providing a firm hold for the would-be intruder.

12 Claims, 6 Drawing Figures

II
3
2
7
4
5
6
1
A
II
3
2
4
7
5

2
4
5
1
3
6
2
4
5
6

INTRUDER BARRIER

BACKGROUND OF THE INVENTION

1. Field of the Invention

The present invention relates to an intruder barrier and in particular, to an intruder barrier of the type which is rotatably mounted on the top of a wall whereby a person attempting to pass over the barrier is prevented from obtaining an effective hand-grip on either the wall or barrier.

2. Description of the Prior Art

In many instances where security devices are required, they are not required to provide an absolute bar to the professional or skilled thief but are more often required to deter vandals or, for example, where there is a likelihood of danger, to prevent children and other unauthorised personnel entering a premises. This is particularly the case, for example, in power stations and the like premises where the perimeter walls, fences and portions of the building musts be so protected as to prevent children and other unauthorised personnel climbing on to or over them. Thus, there are many cases where the security device is not so much to prevent unauthorised entry of the professional thief as to provide a safety device which will prevent untoward accidents. Needless to say, in the latter case the security aspect in also important., Static barriers are well known such as for example, spiked railings, barbed wire or pieces of broken glass embedded in the top of the wall. While some of these methods may restrict the activities of vandals unfortunately, they are not particularly efficient and can be readily easily overcome. More importantly they present a considerable safety hazard.

Further it is known from British Patent Specification No. 612,265 to provide apparatus for preventing or obstructing the scaling of walls, fences and the like barrier which comprises a substantially cylindrical member constituted by a series of rods, bars or sheet material arranged around the perimeters of a number of co-axial discs to produce a cage-like body mounted to rotate on bearing brackets adapted to be secured to the top of a wall or fence. Such devices consist, in their simplest form, of a substantially cylindrical member mounted in bearings to rotate on a substantially horizontal axis along a wall or fence top whereby a person attempting to pass over the barrier is prevented from obtaining an effective handgrip on the wall or barrier which rotates. These devices can be readily easily jammed in one position so that it is then only a question of climbing over a stationary barrier. Thus these devices while more suitable than spiked railings, barbed wire or capping members with inserted broken glass are not, unfortunately, as suitable as they could be for the purpose.

In Deutsche Offenlegungsschrift No. 2,206,436 there is described an intruder barrier substantially similar to the intruder barrier of British Patent Specification No. 612,265 except that this intruder barrier is mounted on a support so as to be movable at least partly at right angles to its longitudinal direction. Generally the device is roughly vertically displaceable, however, this intruder barrier is not necessarily any more efficient in use than the simpler constructions of intruder barrier and additionally, is more complex and costly to manufacture.

The tern "wall" is used in this specification not only to designate a solid wall such as a conventional perimeter wall but also a wall forming part of a building or any type of fence or railing. Additionally, the term "wall" includes the sides of any structure such as a tower or structural steel building or support. The object of the present invention is to provide an improved intruder barrier of the type hereandbefore described which will be efficient in operation while at the same time relatively inexpensive to manufacture.

A further object of the invention is to provide an intruder barrier which will not constitute a man-trap in use.

A still further object of the invention is to provide an intruder barrier that will be particularly userful for mounting on easy scale perimeter fences, for example, chain link fences.

SUMMARY OF THE INVENTION

According to the invention there is provided an intruder barrier for mounting on the surface of a wall comprising:

a scaling barrier rotatable about a longitudinal axis, said barrier being formed by a plurality of blades radially arranged relative to the axis; and a support framework for mounting the barrier on the wall with it's longitudinal axis substantially parallel to the surface of the wall.

In one embodimentof the invention the blades are rotatably mounted on a support shaft which is, in turn, mounted on a support framework, the support shaft defining the longitudinal axis. In another embodiment of the invention each balde diverges from an apex formed by bending a sheet of material intermediate it's ends, portion of the material at the apex being cut-away to interlock with the apex of another blade, or blades thus forming a hole for reception of the support shaft. Preferably, in this latter embodiment there are at least four blades each pair of blades being formed from the one sheet of material. Ideally when there are four blades the angle of the apex between each pair of blades is approximately a right angle. The advantages of the present invention are many and it may be mentioned that the apparatus can be manufactured at a relatively low cost, is simple to erect and generally efficient in use. Further the invention does not constitute a man-trap or any other device that is likely to cause damage to unauthorised intruders while, at the same time, it prevents children or other less skilled personnel from climbing the perimeter wall.

The intruder barrier according to the present invention is particularly suitable for mounting on easily scaled perimeter fences, for example, a chain-link fence. It provides a more efficient barrier than the more conventional means used, such as, the cranking of the uprights away from the vertical, adjacent the top of the fence to provide an overhang or the use of barbed wire strands with the attendant dangers to personnel and consequently to the occupier under public liability legislation.

It should also be noted that a great advantage of the present invention is that it is equally difficult to get out of a premises as it is to get into it and, therefore, it will deter anybody attempting to enter the premises since he or she will be aware that there is no easy exit back over the barrier.

When manufactured of a metal mesh such as expanded metal mesh the metal mesh is almost impossible to climb as the mesh tends to sag and bend under weight while at the same time the edge of the mesh is sufficiently sharp as to cut into a persons hand if any pressure or load is applied and at the same time there is no question of severe injury.

BRIEF DESCRIPTION OF THE DRAWINGS

FIG. 7 is a sectional view showing the barrier mounted on top of a wall.

DETAILED DESCRIPTION OF THE INVENTION

Figures 1, 2, 3:
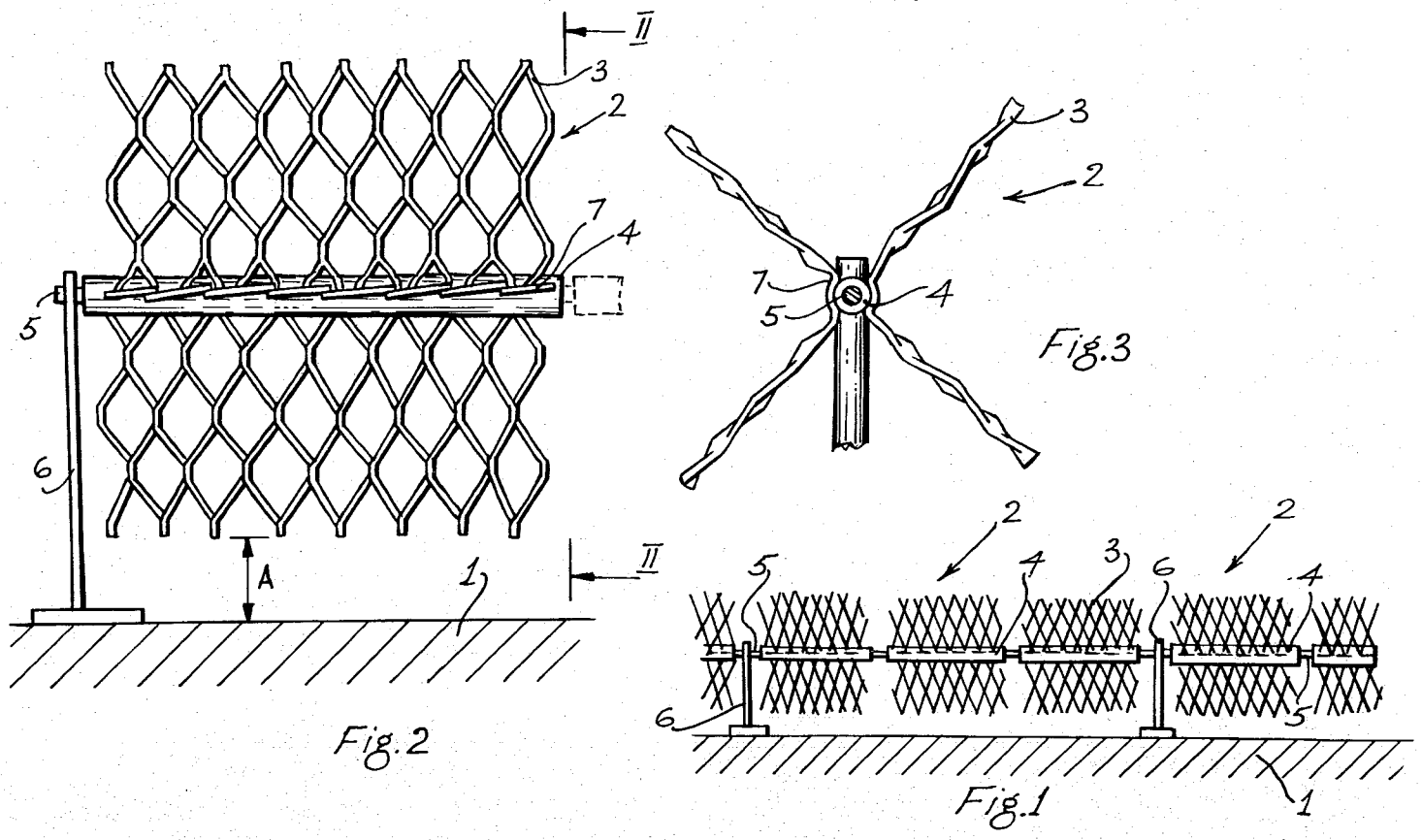
FIG. 1 is an elevation of an intruder barrier according to the invention mounted on a wall.
FIG. 2 is an elevation on an enlarged scale of portion of the intruder barrier of FIG. 1.
FIG. 3 is a cross-sectional view in the direction of the arrows II—II of FIG. 2.

Referring to the drawings and initially to FIGS. 1 to 3 thereof there is illustrated an intruder barrier mounted on a wall 1. The intruder barrier comprises a scaling barrier, indicated generally by the reference numeral 2 formed by a plurality of blades 3 secured to tubing 4 which is rotatably mounted on a support shaft 5. The support shaft 5 forms a longitudinal axis for the scaling barrier which is substantially parallel to the surface of the wall 1. A pair of wall engaging uprights 6 form a support framework for the scaling barrier 2. The blades 3 are of open mesh or net configuration and in this embodiment are manufactured from expanded metal mesh and are welded to the tubing 4 at 7.

The blades 3 are thus constructed of a semi-rigid material which will deform under load but at the same time is not easily doformable. The exposed edges of each blade 3 forms a relatively sharp cutting edge. It will also be noted that there is more than one set of laterally spaced blades on the support shaft 5. Preferably, the minimum spacing A between the bottom of each blade 3 and the top surface of the wall 1 is of the order of 12 cms while at the same time the spacing between two adjacent blades 3 is so arranged to prevent somebody climbing beneath them and over the wall 1. In use, the blades 3 rotate freely under load and present a formidable barrier to a would-be vandal.

Figure 5:
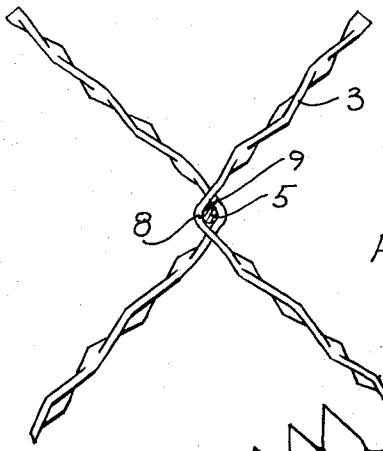
FIG. 5 is a cross-sectional view in the direction of the arrows V—V of FIG. 4.
Figure 6:
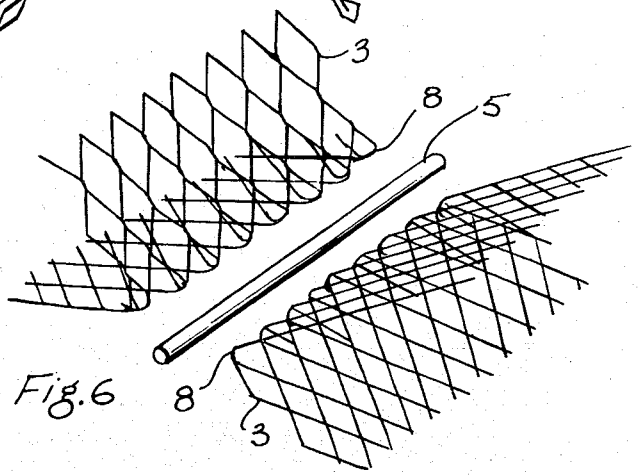
FIG. 6 is an exploded view of portion of the intruder barrier of FIG. 4.
Figure 4:
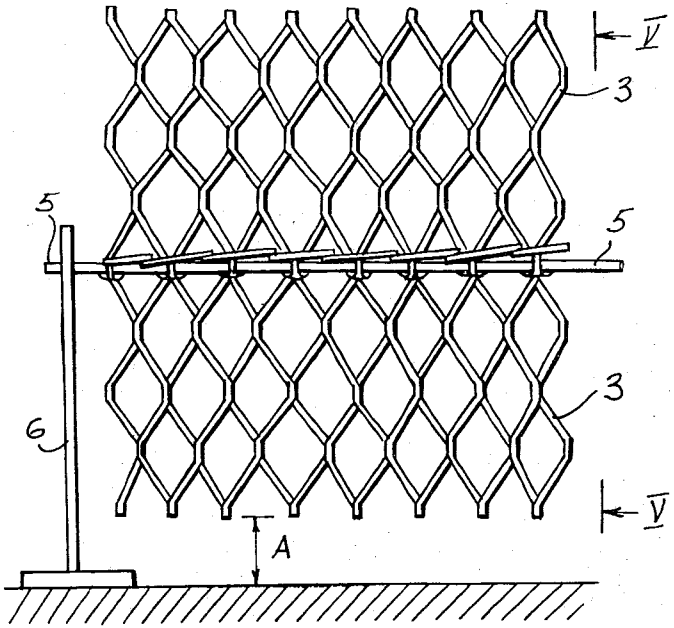
FIG. 4 is an elevation similar to FIG. 2 of portion of another construction of intruder barrier.

Referring to FIGS. 4 to 6 there is illustrated an alternative construction of intruder barrier according to the present invention, like parts are identified by the same reference numerals as used with reference to the description of the embodiment of FIGS. 1 to 3. In this embodiment a pair of blades 3 is formed from the one sheet of material being bent intermediate its ends to form an apex 8 from which the two blades diverge at approximately a right angle. The apices of two pairs of blades 3 interlock to form a hole 9 for reception of the support shaft 5.

It will be appreciated that it is not necessary that the blades be manufactured from an expanded metal mesh material nor indeed, is it necessary to manufacture a pair of blades from the one sheet of material. A blade may in fact be formed by bending a sheet of material intermediate its ends and cutting away portion of the material at the apex to interlock with the apex of another blade or blades thus forming a hole for the reception of a support shaft. The advantage of a mesh or net like material is that there is no need to cut away portion of the material at the apex. The additional advantages of the use of a mesh configuration are firstly, that there is relatively little resistance to air or wind passage therebetween and thus the blades will not rotate in the wind. Another advantage of the use of an expanded metal mesh is that in addition to sagging and bending under weight and having sharp edges so as to cut into a persons hand the actual material itself is sufficiently sharp as to make it very difficult to grip or hold. Also it is very difficult to cut weldmesh as it has not got uniform cross-sections such as, for example, conventional wire has. It is, however, preferable that there be at least four blades and in fact that when there are four blades that the angle at the apex between each pair of blades is approximately a right angle.

Preferably, the intruder barriers according to the present invention are generally of relatively short length as shown thus further foiling an attempt to lock them for scaling.

In a particularly suitable construction of intruder barrier in accordance with the invention it is preferable that there be at least four blades each pair of blades being formed from the one sheet of the material. This has the advantage of saving on material. Ideally when there are four blades the angle at the apex between each pair of blades should be approximately a right angle.

As mentioned above the material forming each blade may be a semi-rigid material deforming under load. Ideally the material is not readily deformable, that is to say it is not easily deformed under load but at the same time is sufficiently deformable as to make it diffcult to jam or otherwise secure in one position.

In accordance with the invention the intruder barrier is so adapted to be secured to the top of a wall and in use project beyond one face thereof, as shown in FIG. 7. Thus, when the intruder barrier projects beyond the face of the wall it is all the more difficult to climb it. Further the intruder barrier may be secured to or incorporated in a vertical wall and adapted to project beyond that face of the wall. This may be of considerable importance where the wall is very high and it would be dangerous if children were to climb to the top of the wall and then fall when trying to climb over an intruder barrier on the top of the wall.

What I claim is:

1. An intruder barrier for mounting on a surface of a wall comprising:

a support shaft having a longitudinal axis;

a support framework on which the support shaft is mounted, for mounting the support shaft on the wall with its longitudinal axis substantially parallel to the surface of the wall; and a scaling barrier mounted on the support shaft to be rotatable about said longitudinal axis, said scaling barrier being formed by a plurality of blades substantially equi-spaced circumferentially and radially arranged relative to said axis, each blade diverging from an apex formed by bending a sheet of material intermediate its ends, portions of the material at the apex being cut away to interlock with the apex of another sheet thus forming a hole for reception of the support shaft.

2. An intruder barrier as recited in claim 1, in which each sheet forms a pair of blades.

3. An intruder barrier as recited in claim 1 in which there are four blades and the angle of the apex between each pair of blades is approximately a right angle.

4. An intruder barrier as recited in claim 1, in which there is more than one set of longitudinally spaced blades on the support shaft.

5. An intruder barrier as recited in claim 1 in which the barrier is adapted to be secured to the top of the wall and, in use, project beyond one vertical face thereof.

6. An intruder barrier as claimed in claim 1 in which the blades are of expanded metal mesh material.

7. An intruder barrier for mounting on a surface of a wall comprising:

a scaling barrier rotatable about a longitudinal axis, said barrier being formed by a plurality of blades of semi-rigid expanded metal mesh material which deforms under load, said blades being substantially equi-spaced circumferentially and radially arranged relative to the axis; and a support framework for mounting the barrier on the wall with its longitudinal axis substantially parallel to the surface of the wall.

8. An intruder barrier as recited in claim 7 in which the blades are rotatably mounted on a support shaft which is, in turn, mounted on the support framework, the support shaft defining the longitudinal axis, and in which there is more than one set of longitudinally spaced blades on the support shaft.

9. An intruder barrier as recited in claim 8 in which the barrier is adapted to be secured to the top of the wall and, in use, project beyond one vertical face thereof.

10. An intruder barrier for mounting on a surface of a wall comprising:

a scaling barrier rotatable about a longitudinal axis, said barrier being formed by a plurality of blades substantially equi-spaced circumferentially and radially arranged relative to the axis, said blades being made of semi-rigid expanded metal mesh sheet material deformable under load of a human intruder; and a support framework for mounting the barrier on the wall with its longitudinal axis substantially parallel to the surface of the wall.

11. An intruder barrier as recited in claim 10 in which the exposed edges of each blade form sharp cutting edges.

12. An intruder barrier as claimed in claim 10 in which the barrier is adapted to be secured to on incorporated in a vertical wall and to project beyond a vertical face of the wall.

* * * * *